US009018572B2

(12) United States Patent
Facciano et al.

(10) Patent No.: US 9,018,572 B2
(45) Date of Patent: Apr. 28, 2015

(54) ROCKET PROPELLED PAYLOAD WITH DIVERT CONTROL SYSTEM WITHIN NOSE CONE

(71) Applicant: Raytheon Company, Waltham, MA (US)

(72) Inventors: Andrew B. Facciano, Oro Valley, AZ (US); Michael S. Alkema, Sahuarita, AZ (US); Robert T. Moore, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 242 days.

(21) Appl. No.: 13/669,935

(22) Filed: Nov. 6, 2012

(65) Prior Publication Data

US 2014/0138475 A1 May 22, 2014

(51) Int. Cl.

| | |
|---|---|
| ***F42B 10/60*** | (2006.01) |
| ***F42B 15/01*** | (2006.01) |
| ***F42B 10/66*** | (2006.01) |
| *F42B 10/00* | (2006.01) |
| *F42B 15/00* | (2006.01) |

(52) U.S. Cl.
CPC ..... *F42B 10/663* (2013.01)

(58) Field of Classification Search
CPC ..... F41G 7/00; F42B 10/60; F42B 10/66; F42B 10/661; F42B 10/663; F42B 10/665; F42B 10/666; F42B 10/668
USPC ..... 244/3.1, 3.15, 3.21, 3.22, 3.16–3.2, 1 R, 244/158.1, 164, 169, 171, 171.1, 171.7, 244/173.1, 117 R, 119, 121; 102/374, 377, 102/378; 343/872, 873
See application file for complete search history.

(56) References Cited

U.S. PATENT DOCUMENTS

| | | | | | |
|---|---|---|---|---|---|
| 2,726,510 | A | * | 12/1955 | Goddard | 244/3.22 |
| 3,018,981 | A | * | 1/1962 | Weller | 244/3.22 |
| 3,034,434 | A | * | 5/1962 | Swaim et al. | 244/3.22 |
| 3,093,346 | A | * | 6/1963 | Faget et al. | 244/3.22 |
| 3,301,508 | A | * | 1/1967 | Yamron | 244/3.18 |
| 3,341,152 | A | * | 9/1967 | Kantrowitz et al. | 244/3.22 |
| 3,446,023 | A | * | 5/1969 | Mosier | 244/3.22 |
| 3,502,285 | A | * | 3/1970 | Gambill | 244/3.22 |
| 3,502,288 | A | * | 3/1970 | Pavlin et al. | 244/3.22 |
| 3,540,679 | A | * | 11/1970 | McCullough et al. | 244/3.22 |
| 4,519,315 | A | * | 5/1985 | Arszman | 102/377 |

(Continued)

FOREIGN PATENT DOCUMENTS

| | | | | |
|---|---|---|---|---|
| DE | 3429798 C1 | * | 12/1985 | F24B 15/033 |
| EP | 0128337 B1 | * | 1/1988 | F24B 15/033 |

OTHER PUBLICATIONS

International Search Report issued in PCT/US2013/057771, Mar. 20, 2014, 8 pages.

(Continued)

*Primary Examiner* — Bernarr Gregory
(74) *Attorney, Agent, or Firm* — Cantor Colburn LLP

(57) ABSTRACT

A rocket is provided and includes booster stages at a rear of the nose cone, the booster stages being configured for propelling the nose cone in a propulsion direction and a divert control system housed entirely in the nose cone for controlling an orientation of the propulsion direction.

20 Claims, 4 Drawing Sheets

(56) References Cited

U.S. PATENT DOCUMENTS

| | | | | | |
|---|---|---|---|---|---|
| 4,522,357 | A | * | 6/1985 | Bains et al. | 244/3.22 |
| 4,573,648 | A | * | 3/1986 | Morenus et al. | 244/3.22 |
| 4,589,594 | A | * | 5/1986 | Kranz | 244/3.22 |
| 4,681,283 | A | * | 7/1987 | Kranz | 244/3.22 |
| 5,054,712 | A | * | 10/1991 | Bar et al. | 244/3.22 |
| 5,060,550 | A | | 10/1991 | Hoever et al. | |
| 5,123,612 | A | * | 6/1992 | Labroche et al. | 244/3.22 |
| 5,238,204 | A | | 8/1993 | Metz | |
| 5,433,399 | A | * | 7/1995 | Becker et al. | 244/3.22 |
| 5,456,425 | A | | 10/1995 | Morris et al. | |
| 6,360,993 | B1 | | 3/2002 | Turner | |
| 6,565,036 | B1 | | 5/2003 | Palathingal et al. | |
| 6,629,668 | B1 | * | 10/2003 | Grau et al. | 244/3.22 |
| 6,766,979 | B2 | * | 7/2004 | Horwath | 244/3.17 |
| 7,012,233 | B2 | | 3/2006 | Brown et al. | |
| 7,082,878 | B2 | | 8/2006 | Facciano et al. | |
| 7,989,744 | B2 | * | 8/2011 | Facciano et al. | 244/3.22 |
| 8,104,719 | B2 | | 1/2012 | Shiau et al. | |
| 8,146,862 | B2 | | 4/2012 | Chirivella et al. | |
| 8,735,788 | B2 | * | 5/2014 | Preston et al. | 244/3.22 |
| 2005/0000383 | A1 | | 1/2005 | Facciano et al. | |
| 2007/0074636 | A1 | | 4/2007 | Rieger et al. | |
| 2012/0145028 | A1 | | 6/2012 | Travis | |
| 2012/0211596 | A1 | | 8/2012 | Preston et al. | |

OTHER PUBLICATIONS

Written Opinion issue in PCT/US2013/057771, Mar. 20, 2014, 7 pages.

* cited by examiner

ROCKET PROPELLED PAYLOAD WITH DIVERT CONTROL SYSTEM WITHIN NOSE CONE

BACKGROUND

The present disclosure relates generally to a rocket propelled payload with a divert control system contained within the nose cone.

Rocket propelled payloads are used in various aerodynamic applications and may refer to kinetic weapons (or kinetic vehicles), non-weaponized vehicles or satellites. Kinetic weapons, in particular, are devices that are propelled at high speeds in order to intercept other devices in-flight. Upon impact, the kinetic weapon damages the target or at least diverts the target from its flight path.

The overall structure of a rocket propelled payload includes a nose cone and a fuselage. The nose cone contains the payload and the fuselage contains booster stages that burn solid rocket fuel in stages. Exhaust from the combustion of the solid rocket fuel is ejected out of the rear of the active booster stage to provide for propulsion in the forward direction. In addition, exhaust may be ejected out of lateral propulsion elements arrayed along the sides of the booster stages to provide for attitude control or a booster attitude control system (ACS).

Due to the containment of the solid rocket fuel in the fuselage in the conventional configuration, booster ACS is often required to be relatively large and have several redundant or duplicative elements. Moreover, since the solid rocket fuel has a relatively low impulse capability paired with the fact that the propulsion elements are proximate to a center of mass of the rocket, a relatively large amount of solid rocket fuel may be needed, which leads to an increase in overall weight. In addition, since the propulsion elements are arrayed along the sides of the booster stages, nozzles associated with the propulsion elements are not often optimized while the slew angles of the propulsion elements are limited by the aerodynamic requirements of the overall unit.

SUMMARY

According to one embodiment, a rocket is provided and includes booster stages at a rear of the nose cone, the booster stages being configured for propelling the nose cone in a propulsion direction and a divert control system housed entirely in the nose cone for controlling an orientation of the propulsion direction.

According to another embodiment, a rocket is provided and includes a nose cone and booster stages at a rear of the nose cone, the booster stages being configured for propelling the nose cone in a propulsion direction. The nose cone includes a body defining an interior and perforations, a tank configured to contain propellant, nozzles interposed between the tank and the perforations, secondary nozzles for payload attitude control and a sensor assembly. The sensor assembly is configured to execute divert control to cause the propellant to be expelled from the tank and through the perforations via the nozzles to thereby control an orientation of the propulsion direction.

According to yet another embodiment, a nose cone of a rocket propelled payload is provided and includes a body defining an interior and perforations, a tank configured to contain propellant, nozzles interposed between the tank and the perforations and a sensor assembly configured to execute divert control and to cause the propellant to be expelled from the tank and through the perforations via the nozzles to thereby control an orientation of a propulsion direction of the rocket propelled payload.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

The description provided below relates to a rocket propelled payload in which a divert control system and propellant for the divert control system are housed entirely in a perforated nose cone nozzle extension assembly (PNNEA). This allows for the elimination of booster ACS and provides for an increased moment in divert control and reduced propellant loading. In addition, the configuration described below calls for high impulse liquid propellant and provides space for nozzles with high slew angles that are optimized with high expansion ratios. The configuration described below also permits the removal of multi-stage booster ACS and leads to overall weight and program risk reduction as well as the elimination of redundant hardware, including energetic devices like igniters and pyrotechnical elements.

Figure 1:
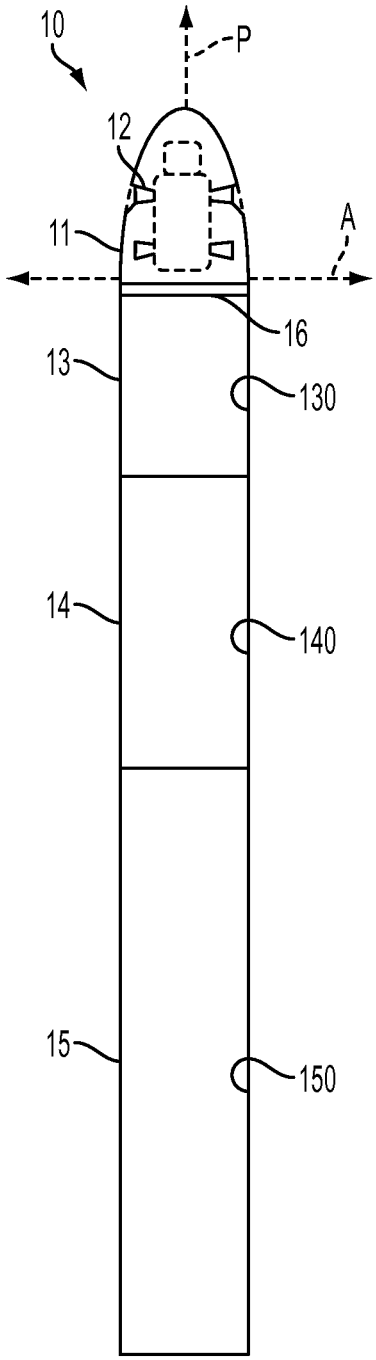
FIG. 1 is a plan view of a kinetic weapon in accordance with embodiments.

With reference to FIG. 1, a rocket 10 is provided as a payload delivery element. The payload may include, for example, a kinetic weapon (KW), a kinetic or kill vehicle (KV), a non-weapon vehicle (i.e., a planetary rover) or a satellite. The rocket 10 includes a body 11 having a nose cone 12, at least booster stages 13, 14 and 15 and a booster guidance element 16. The booster guidance element 16 generally resides at a rear of the nose cone 12. The booster stages 13, 14 and 15 are substantially cylindrical in shape and are sequentially disposed at a rear of the booster guidance element 16. The booster stages 13, 14 and 15 are configured to propel the nose cone 12 forward in a propulsion direction P. As shown in FIG. 1, the propulsion direction P is generally aligned with a longitudinal axis of the body 11. Thus, as the rocket 10 is propelled forward in the propulsion direction P, the nose cone 12 leads the booster stages 13, 14 and 15. The propulsion direction P may be contrasted with divert directions A, which are oriented substantially transversely or perpendicularly to the propulsion direction P.

The booster stages 13, 14 and 15 are not configured to provide attitude control. That is, the rocket 10 may not include a booster ACS. Thus, the booster stages 13, 14 and 15 need not be provided with lateral propulsion elements and, therefore, the booster stages 13, 14 and 15 may each be provided with respective outer walls 130, 140 and 150 that are substantially smooth along entire longitudinal lengths thereof. Moreover, the booster stages 13, 14 and 15 need not be provided with fuel or separate ignition and pyrotechnic features that would otherwise be required for booster ACSs. This leads to a substantial reduction in weight and elimination of failure modes for each booster stage 13, 14 and 15.

Although the rocket 10 of FIG. 1 has been illustrated with booster stages 13, 14 and 15, it is to be understood that a number of the booster stages may be increased or decreased based on an application of the rocket 10. As such, the embodiment illustrated in FIG. 1 is to be considered merely exemplary and non-limiting of the present application as a whole.

During an operation of the rocket 10, the booster stages 13, 14 and 15 are activated in a launch egress sequence that propels the rocket 10 forward in the propulsion direction. Following launch, the rocket 10 proceeds toward its target and divert control, which will be described in detail below, can be executed at this time. As the rocket 10 nears its target, the nose cone 12 is ejected from the first booster stage 13 once the rocket 10 has attained a velocity sufficient to propel the nose cone 12 to the target. Following the ejection of the nose cone 12 from the booster stage 13, a payload is ejected from the nose cone 12 and payload ACS may be executed in order to maintain a proper orientation of the payload.

Figure 2:
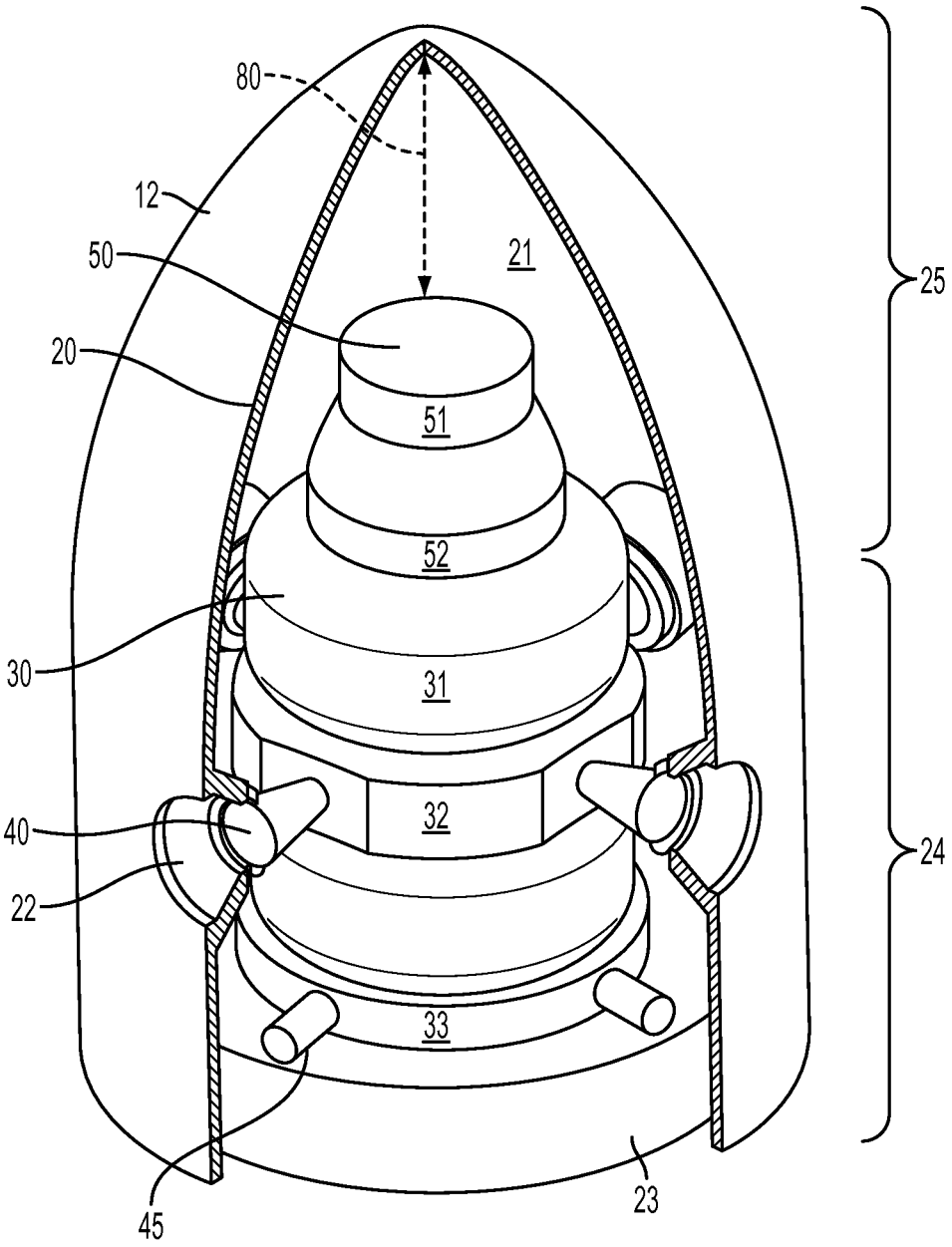
FIG. 2 is a perspective cutaway view of a nose cone of the kinetic weapon of FIG. 1 in accordance with further embodiments.
Figure 3:
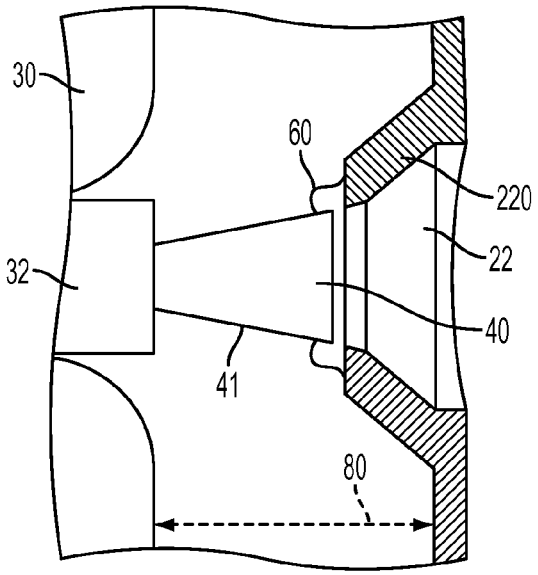
FIG. 3 is an enlarged view of a nozzle of the nose cone of FIG. 2 in accordance with embodiments.

With reference to FIGS. 2 and 3, the nose cone 12 includes a nose cone body 20 that is formed to define a nose cone interior 21 and perforations 22 that permit execution of the divert control. The nose cone body 20 extends forwardly from base 23 and is a generally thin walled element, which may be provided as a radome that permits electromagnetic radiation of one or more frequencies to pass through the nose cone body 20 inwardly and outwardly. Such electromagnetic radiation may include signals by which respective locations of the rocket 10 and its target are transmittable.

The nose cone 12 further includes a tank 30, nozzles 40, secondary nozzles 45 for payload ACS and a sensor assembly 50, which together form the payload. The tank 30 is configured to contain propellant 31, such as high impulse liquid propellant, and in some cases an additional type of propellant. The nozzles 40 are operably interposed between the tank 30 and the perforations 22 at or substantially near the center of mass of the nose cone 12. In this position, the nozzles 40 are displaced from the center of mass of the rocket 10 and thereby provide divert control to the rocket 10 prior to nose cone 12 ejection. In so doing, the nozzles 40 may permit booster ACS to be discarded from the configuration of the rocket 10. The secondary nozzles 45 are operably coupled to the tank 30 and enclosed at least initially within the nose cone 12 at a distance from the center of mass of the nose cone 12. The secondary nozzles 45 provide for execution of the payload ACS following ejection of the nose cone 12 and the subsequent ejection of the payload from the nose cone 12.

The sensor assembly 50 includes a seeker 51 and a guidance electronics unit (GEU) 52. The seeker 51 provides targeting information to the GEU 52 for interception usage so that a desired orientation of the rocket 10 and the nose cone 12 can be achieved in flight. The GEU 52 houses an inertial measurement unit (IMU) with necessary accelerometers and gyros to provide for guidance, navigation and control (GNC) functionality. One or both of the GEU 52 and the booster guidance element 16 may be coupled to the nozzles 40 and thereby configured to cause the propellant 31 to be expelled from the tank 30 and through the perforations 22 via the nozzles 40. In this way, the sensor assembly 50 or the booster guidance element 16 can control an orientation of the rocket 10 in flight by controlling thrust in any of the one or more of the divert directions A.

That is, as the propellant 31 is expelled from the tank 30 and through one or more of the perforations 22 via the corresponding one or more of the nozzles 40, the orientation of the propulsion direction P is changed in accordance with the one or more of the active nozzles 40 and the amount of expelled propellant 31. Since this expulsion occurs well ahead of the center of mass of the rocket 10 as a whole, a substantial change in the orientation of the propulsion direction P is possible with a limited amount of expelled propellant 31. In this way and especially with high impulse liquid propellant being used, an amount of propellant 31 that may be required for a given operation of the rocket 10 may be reduced as compared with an amount of low impulse solid propellant that is normally required for conventional booster ACS.

The tank 30 may be an annular element that is formed of rigid or flexible materials. The nozzles 40 are sealably coupled to the tank 30 along openings defined through a ring member 32. The ring member 32 seals the coupling between the nozzles 40 and the tank 30 and prevents infiltration of the nose cone interior 21 by propellant being exhausted from the tank 30. The secondary nozzles 45 are similarly sealably coupled to the tank 30 along openings defined through a secondary ring member 33. The secondary ring member 33 seals the coupling between the secondary nozzles 45 and the tank 30 and prevents infiltration of the nose cone interior 21 by propellant being exhausted from the tank 30.

The nozzles 40 and the perforations 22 may be arranged substantially uniformly about the nose cone 12. In accordance with embodiments, the nozzles 40 and the perforations 22 may be provided in a set of four nozzle/perforation pairs. In such a case, each nozzle/perforation pair would be displaced from adjacent pairs by 90°. Of course, it is to be understood that the 4-nozzle arrangement is merely exemplary and that more or less nozzles may be used.

The secondary nozzles 45 may be arranged substantially uniformly as well. In accordance with embodiments, the secondary nozzles 45 may be provided in a set of four. In such a case, each secondary nozzle 45 would be displaced from adjacent secondary nozzles 45 by 90°. Of course, it is to be understood that the 4-nozzle arrangement is merely exemplary and that more or less secondary nozzles 45 may be used.

Figure 4:
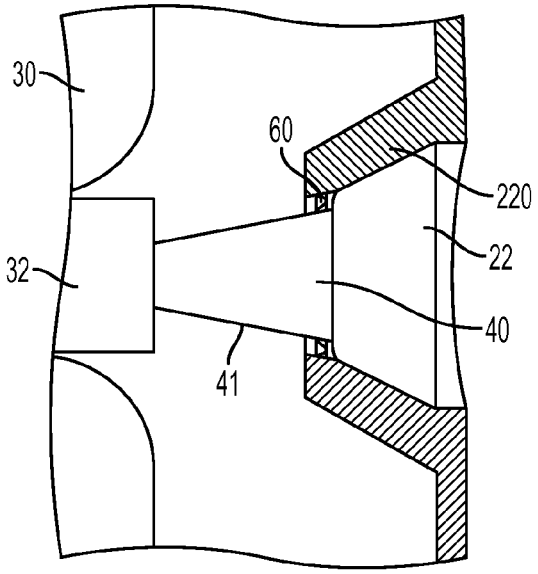
FIG. 4 is an enlarged view of nozzle of the nose cone of FIG. 2 in accordance with alternative embodiments.

With reference to FIGS. 3 and 4, the perforations 22 may be provided as through-holes extending from an interior surface of the nose cone body 20 to an exterior surface of the nose cone body 20. In accordance with further embodiments, the nose cone body 20 may further include inwardly extending flanges 220 that extend inwardly from the nose cone body 20 toward the nozzles 40 at the locations of the perforations 22. In either case, the nozzles 40 may extend outwardly to connect with the nose cone body 20 at the perforations 22 or with the inner-most portions of the flanges 220. As shown in FIGS. 3 and 4, the nozzles 40 extend outwardly with a taper whereby a diameter of the nozzles 40 at their outer-most portions exceeds their inner diameters. In addition, the taper is formed such that the nozzles 40 form an oblique angle with either the nose cone body 20 or the flanges 220. Where the perforations 22 include the flanges 220, the flanges 220 may be frustoconically shaped with a taper angle that is similar to or greater than a taper angle of the nozzles 40.

The material of the sidewalls of the nozzles 40 may be rigid or flexible. In either case, the nozzles 40 may be directly connected with the nose cone body 20 or the flanges 220 or sealably coupled to the nose cone body 20 or the flanges 220. In the latter case, flexible seal elements 60 may be provided, for example, between the outer-most portions of the nozzles 40 and the inner-most portions of the flanges 220. As shown in FIG. 3, the outer-most portions of the nozzles 40 may be disposed inside the inner-most portions of the flanges 220 whereby the flexible seal elements 60 traverse the radial distance between the nozzles 40 and the flanges 220. As shown in FIG. 4, the outer-most portions of the nozzles 40 are coaxial with the inner-most portions of the flanges 220 and the flexible seal elements traverse the axial distance between nozzles 40 and the flanges 220.

Figure 5A:
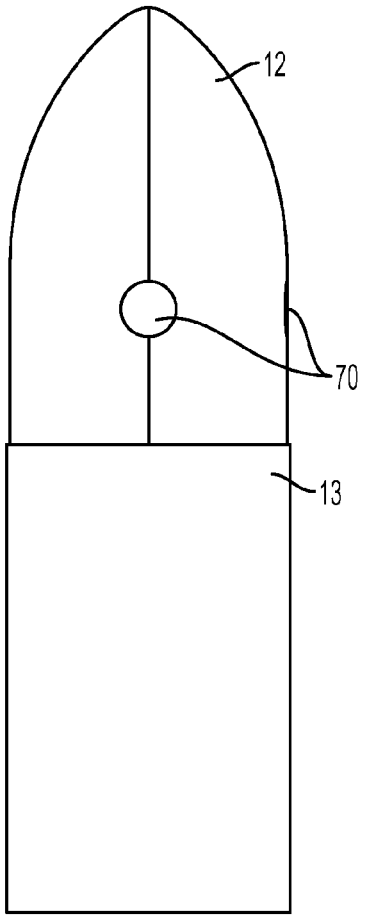
FIG. 5A is a plan view of nozzle covers of the kinetic weapon of FIG. 1 in operation.
Figure 5B:
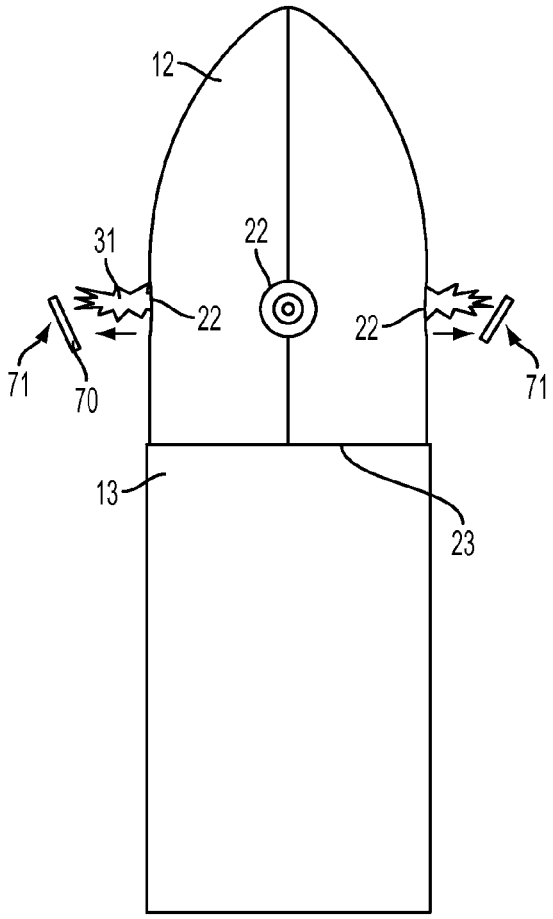
FIG. 5B is a plan view of the nozzle covers of the kinetic weapon of FIG. 1 in operation.

With reference to FIGS. 5A and 5B, the nose cone 12 may further include nozzle covers 70. The nozzle covers 70 are formed as plate-shaped members 71 that are configured to at least temporarily fit into the perforations 22. For example, at the launch stage, the nozzle covers 70 may be employed to cover the perforations 22 and to thereby maintain a relatively smooth outer surface of the nose cone body 20 (see FIG. 5A). Thus, during relatively low speed launch egress maneuvers, the aerodynamic advantages of a smooth outer surface of the nose cone body 20 are employed. Then, when divert control is initiated for example as the rocket 10 proceeds toward its target, the nozzle covers 70 may be blown out of the perforations 22 by the initial blast of expelled propellant 31 (see FIG. 5B).

With reference to FIGS. 2 and 3, a separation 80 is formed between the nose cone body 20 and the various components described above due to the radial length of the nozzles 40 and, where applicable, the flanges 220 relative to the tank 30. The separation 80 permits increased vibration in the nose cone 12 as the distance between the nose cone body 20 and the various components make it unlikely that undesirable contact will be made. Moreover, the flexibility of the nozzles 40 and the flexible seal elements 60 dampens any vibration that exists. This dampening leads to additional permissive vibration tolerance and greater freedom in rocket 10 design.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the embodiments in the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A rocket, comprising:

a nose cone including a payload having a payload attitude control system (ACS);

booster stages sequentially disposed at a rear of the nose cone, the booster stages being configured for propelling the nose cone in a propulsion direction; and a divert control system housed entirely in the nose cone for controlling an orientation of the propulsion direction, wherein:

the nose cone is configured for ejection from the booster stages once a predefined velocity is attained, and the payload is configured for ejection from the nose cone following nose cone ejection from the booster stages with the payload ACS then executable to maintain payload orientation.

2. The rocket according to claim 1, wherein the nose cone comprises:

a body defining an interior and having perforations passing therethrough;

a tank configured to contain propellant;

nozzles interposed between the tank and the perforations; and a sensor assembly configured to execute divert control to thereby cause the propellant to be expelled from the tank and through the perforations via any one or more of the nozzles.

3. The rocket according to claim 2, wherein the propellant comprises liquid propellant.

4. The rocket according to claim 2, wherein the nose cone comprises a base separating the tank from the booster stages, the body extending forwardly from the base.

5. The rocket according to claim 2, wherein the nozzles and the perforations are arranged uniformly about the nose cone.

6. The rocket according to claim 2, wherein sidewalls of the nozzles form an oblique angle with the body.

7. The rocket propelled payload according to claim 2, further comprising flexible seal elements operably disposed between the nozzles and the body.

8. The rocket according to claim 2, wherein the sensor assembly comprises a seeker to determine a desired orientation.

9. The rocket according to claim 2, further comprising nozzle covers disposed in the perforations.

10. A rocket, comprising:

a nose cone including a payload configured for ejection from the nose cone; and booster stages sequentially disposed at a rear of the nose cone, the booster stages being configured for propelling the nose cone in a propulsion direction;

the nose cone including a body defining an interior and having perforations passing therethrough, a tank configured to contain propellant, nozzles interposed between the tank and the perforations, secondary nozzles for executing payload attitude control following payload ejection from the nose cone and a sensor assembly;

the sensor assembly being configured to execute divert control to cause the propellant to be expelled from the tank and through the perforations via the nozzles to thereby control an orientation of the propulsion direction, wherein the nose cone is configured for ejection from the booster stages once a predefined velocity is attained.

11. The rocket according to claim 10, wherein the booster stages each comprise an outer wall that is smooth along entire longitudinal lengths thereof.

12. The rocket according to claim 10, wherein the propellant comprises liquid propellant.

13. The rocket according to claim 10, wherein the nose cone comprises a base separating the tank from the booster stages, the body extending forwardly from the base.

14. The rocket according to claim 10, wherein the nozzles and the perforations are arranged substantially uniformly about the nose cone.

15. The rocket according to claim 10, wherein sidewalls of the nozzles form an oblique angle with the body.

16. The kinetic weapon according to claim 10, further comprising flexible seal elements operably disposed between the nozzles and the body.

17. The kinetic weapon according to claim 10, wherein the nose cone comprises a non-explosive warhead.

18. The rocket according to claim 10, further comprising nozzle covers disposed in the perforations.

19. A nose cone of a rocket propelled payload, the nose cone being configured for ejection from booster stages sequentially disposed at a rear of the nose cone and comprising:

a body defining an interior and having perforations passing therethough; and a payload configured for ejection from the nose cone, the payload comprising a tank configured to contain propellant, nozzles interposed between the tank and the perforations, secondary nozzles for executing payload attitude control following payload ejection from the nose cone and a sensor assembly configured to execute divert control and to cause the propellant to be expelled from the tank and through the perforations via the nozzles to thereby control an orientation of a propulsion direction of the rocket propelled payload.

20. The nose cone according to claim 19, further comprising nozzle covers disposed in the perforations.

* * * * *